United States Patent [19]

Hunter

[11] Patent Number: 4,630,793

[45] Date of Patent: Dec. 23, 1986

[54] BABY BOTTLE BELT

[76] Inventor: Leslye Hunter, 36 Lakeland Ave., Congers, N.Y. 10920

[21] Appl. No.: 669,266

[22] Filed: Nov. 7, 1984

[51] Int. Cl.[4] ..... A47D 15/00

[52] U.S. Cl. ..... 248/102

[58] Field of Search ..... 248/102–106, 248/311.3; 224/148, 904, 250, 253, 254

[56] References Cited

U.S. PATENT DOCUMENTS

| | | | |
|---|---|---|---|
| 1,375,917 | 4/1921 | Paugh | 248/102 |
| 1,630,167 | 5/1927 | Cardarella | 248/102 |
| 2,050,841 | 8/1936 | Houghton | 248/102 |
| 2,182,164 | 12/1939 | Rosenberg | 248/102 |
| 2,579,701 | 12/1951 | Ridey | 248/102 |
| 2,841,349 | 7/1958 | Charles | 248/104 |
| 3,635,430 | 1/1972 | Emond | 248/102 |
| 4,062,510 | 12/1977 | Brochu | 248/102 |
| 4,446,944 | 5/1984 | Forrest | 182/3 |

FOREIGN PATENT DOCUMENTS

| | | | |
|---|---|---|---|
| 82011 | 7/1953 | Norway | 224/148 |
| 589203 | 6/1947 | United Kingdom | 248/104 |

*Primary Examiner*—Reinaldo P. Machado
*Assistant Examiner*—Alvin Chin-Shue
*Attorney, Agent, or Firm*—Lackenbach Siegel Marzullo Presta & Aronson

[57] ABSTRACT

A baby bottle holder system that includes an elongated, flexible belt removably attached to a pair of arms extending from a child's seat such as a stroller or a high chair and a biasable loop member adapted to hold a baby bottle connected to the center portion of the belt. In the non-use position, the belt hangs downwards and the loop member is disposed below the horizontal plane of the pair of arms. In the use position, the child has pulled the bottle upwards to his mouth and the loop member is positioned above the plane of the arms. A unitary biasable belt and loop member or a biasable loop member attached to a flexible belt can be used. Removable attaching means such as snap-on connections are used to secure the belt to the arms of the seat.

2 Claims, 7 Drawing Figures

BABY BOTTLE BELT

The present application relates to a baby bottle holder and, more specifically, to a baby bottle holder secured to a belt that is secured to the frame of a stroller, a high chair, an infant's car seat, a grocery cart, and the like.

BACKGROUND OF THE INVENTION

Prior art devices generally related to baby bottle holders include the following United States patents: U.S. Pat. No. 3,543,976 issued Dec. 1, 1970 to Bella Ronald; U.S. Pat. No. 3,850,393 issued Nov. 26, 1974, to Harold J. Marquard; U.S. Pat. No. 4,096,977 issued June 27, 1978 to George W. Barville et al; and U.S. Pat. No. 4,220,302 issued Sept. 2, 1980 to Jarold L. Hampton et al.

The Ronald patent discloses a bottle holder that includes a pliable strap 14 that has one end formed as a loop 18 provided with a slide buckle 22 for adjusting the loop. The baby bottle is attached to strap 14 at loop 18. Adjusting means are provided for strap 14 and loop 18. Strap 14 is placed about the neck of the infant.

The Marquard patent discloses a U-shaped clamp 14 adapted to hold the baby bottle. Clamp 14 is secured to a pliable base member 12 which in turn is secured to a strap 14 hung around the neck of the mother.

The Barville et al. patent discloses a flexible retaining ring 17 for retaining a baby bottle. Ring 17 is coupled to a flexible element 15 that is received to a harness that is mounted to the upper torso of the infant.

The Hampton et al. patent discloses a bottle strap 30 that is secured to a shoulder strap 20 that is hung diagonally across the chest and one shoulder of the mother. Connector strips 21 and 22 are provided on opposed surfaces of shoulder strap 20. A velcro pad 27 is disposed on the outer surface of strap 20 that is engageable with a mating pad on the outer surface of bottle strap 30.

One recently advertised device for holding a baby bottle describes a baby bottle holder secured to a quilted bib hung from the neck of the child. Another recently advertised device is a bottle holder that is secured to a pair of elongated, curved arms in turn connected to clamps adapted to be fastened to furniture, a high chair, a child's car seat, a stroller and the like.

SUMMARY OF THE INVENTION

Accordingly, it is a principal object of the present invention to provide a baby bottle holder that can be easily secured to and removed from a stroller or the like and that can be conveniently and safely used by the child.

It is another object of the present invention to provide a baby bottle holder system that includes a bottle holder secured to a flexible belt that can be easily secured to the arms of a stroller, high chair, or the like and easily manipulated for use by the child.

It is yet another object of the present invention to provide a baby bottle holder system that includes a biasable, or stretchable, loop for holding a baby bottle that in turn is secured to a flexible belt having fastening grips at opposite ends for securing the belt to the arms of a baby stroller or the like.

It is yet another object of the present invention to provide a baby bottle holder system that includes a biasable loop for holding a baby bottle that in turn is secured to a biasable, or stretchable, belt having fastening grips at opposite ends for securing the belt to the arms of a baby stroller or the like.

Accordingly, there is provided a baby bottle holder system for attachment to a pair of generally horizontal, parallel side arms extending from the seat area of a support for a child, an elongated, flexible belt having opposed sides and opposed end portions; connectors, such as snap-on connectors, positioned at the opposed end portions of the belt that are adapted to removably secure the belt to each of pair of arms; and a loop member connected to the mid-area of the belt for holding the body of a baby bottle. The belt is movable between non-use and use positions. In the non-use position, the belt hangs downwards and the loop member is disposed below the horizontal plane of the pair of arms; and in the use position, the belt is raised upwards and the loop member is positioned above the plane of the pair of arms with the nipple of the bottle positioned at the mouth of the infant. The loop member and the belt can be unitary of a biasable material. Alternatively, the belt can be made of a flexible material and the loop member can be made of a biasable material and attached to the flexible belt.

BRIEF DESCRIPTION OF THE DRAWINGS

The invention will now be described with reference to the accompanying drawings, wherein.

DESCRIPTION OF THE PREFERRED EMBODIMENTS

Reference is now made in detail to the drawings.

Figure 1:
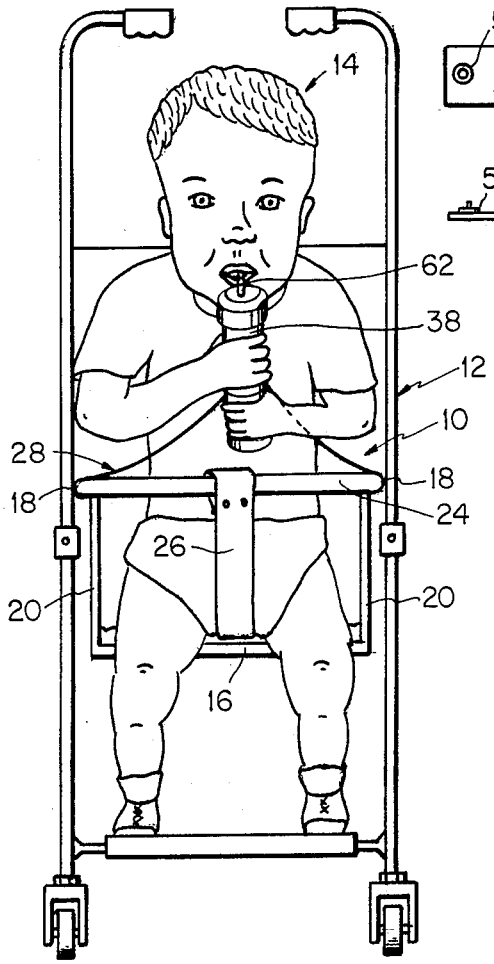
FIG. 1 is a frontal view of the baby bottle holder system attached to the arms of a stroller.

A baby bottle holder system 10 is shown in FIG. 1 mounted to a typical child's stroller 12 by way of example. A small child 14 is shown in the seat 16 of the stroller, which has a pair of generally horizontal, parallel supporting arms 18. A pair of vertically extending side support straps 20 are secured to side arms 18. A front bar 24 is shown connecting side arms 18. A vertically extending front strap 26 is connected to front bar 24. Side straps 20 and front strap 26 support stroller seat 16 in a known manner.

Baby bottle holder system 10 includes an elongated, flexible belt 28 having opposed top and bottom sides 30 and 32 respectively and opposed end portions 34. A biasable, or stretchable, loop member 36 is connected to the mid-area of belt 28. Biasable loop member 36 forms a hole 38 in which is mounted a standard baby bottle 38. Hole 38 is slightly smaller than the body of baby bottle 38 so that loop member 36 is slightly biased against the body of baby bottle 38 so as to grip baby bottle 38 in a non-slip position. Baby bottle 38 can be positioned or released in or from hole 40 by biasing loop member 36. Loop member 36 and belt are preferably of the width.

Figure 3A:
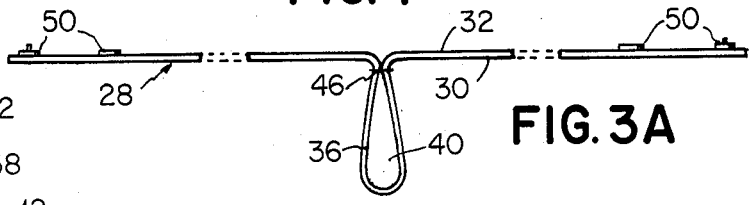
FIG. 3A is a side/view of biasable belt and loop member.

FIG. 3A illustrates a biasable loop member 36 and a flexible biasable belt 28 that are made from a continuous strip of biasable material. The bottom portion of loop member 36 is connected by a sewn connector 46 at the interjoined section between belt 28 and loop member 36. An elliptical metal grip 48 can be optionally positioned around sewn connector 42 to aid in keeping the portions of loop member 36 nearest belt 28 pressed together.

Figure 3B:
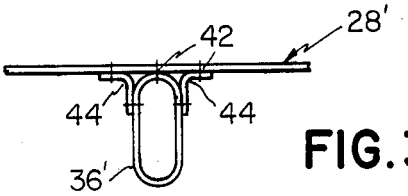
FIG. 3B is an isolated side view of a biasable loop member attached to a separate flexible belt.

FIG. 3B illustrates a biasable loop member 36' secured to top side 30 of a separate flexible belt 28' by a sewn connection 42 at the contact portion between loop member 36' and belt 28'. In addition, as optional additional reinforcing, a pair of oppositely positioned support straps 44 are sewn to the sides of loop member 36' and top side 30. Strips 44 can optionally be made of biasable material as is loop member 36'.

Figure 4:
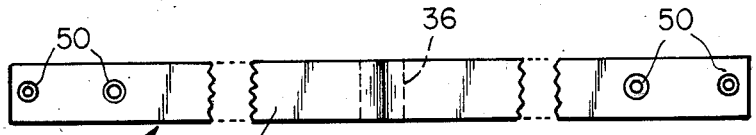
FIG. 4 is a bottom view of the belt and loop holder.
Figure 5A:
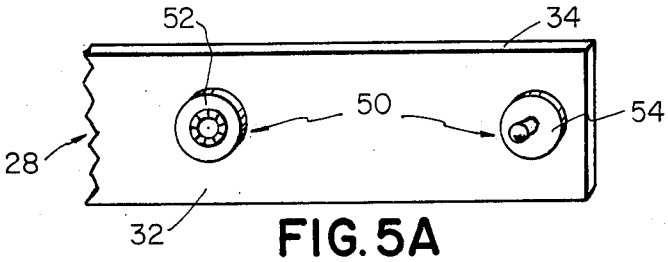
FIG. 5A is a detailed bottom view of a belt having a snap-on end fastener.
Figure 2:
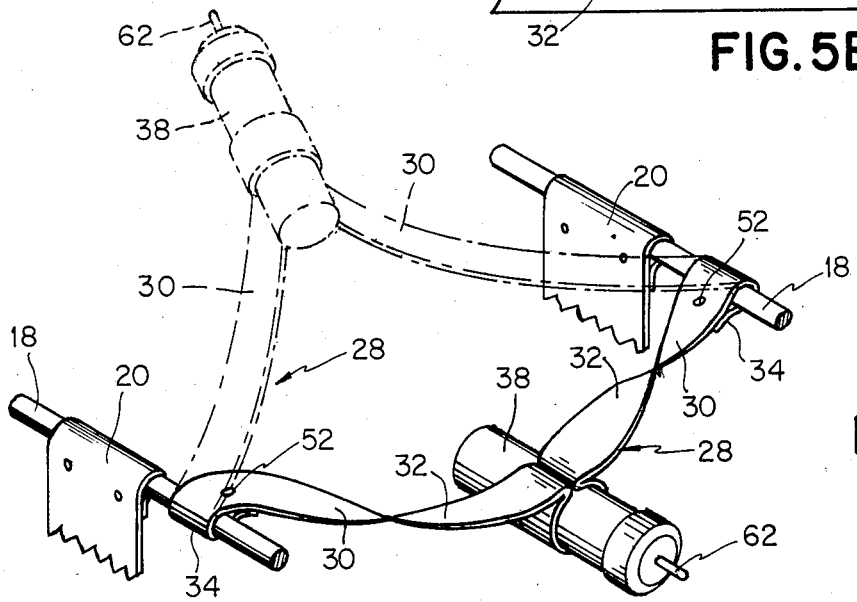
FIG. 2 is a perspective view of the bottle holder system disposed a non-use mode and in a use mode in phantom lines.

Belt 28 is removably connected to side arms 18 by snap-on connectors 50, for example, which are shown in detail in FIG. 5A and generally in FIGS. 4, 3A and 2. Snap-on connectors 50 can be wrapped around side arms 18 at any position along the side arms. As seen in FIG. 5A, connectors 50 are connected to bottom side 32 of belt 28 and positioned forward of side straps 20 relative the child 14. Each connector 50 typically includes a female receptacle 52 and a male projection 54, each secured to belt 28 in a known manner, with male projection 54 being capable of being removably captured by female receptacle 52 in a manner known in the art. Female receptacle 52 and male projection 54 are spaced apart at such a distance so as to allow end portions 34 to encircle side arms 18.

Figure 5B:
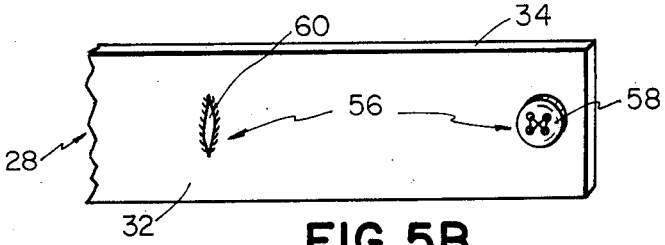
FIG. 5B is a detailed bottom view of a belt having a button-on end fastener.

Belt 28 can be alternatively removably secured to side arms 18 by other means. For example, FIG. 5B illustrates one of a pair of button-on connectors 56 at one of end portions 34 of belt 28. Button-on connector 56 includes a buttom 58 sewn to bottom side 32 of belt 28 and a button hole 60 formed by belt 28, with button 58 being preferably positioned closest to the end of belt 28. Button 58 and button hole 60 are spaced apart at a distance adapted to allow each end portion 34 to encircle side arms 18.

Other connecting devices can be used to secure belt 28 to varied types of side arms. For example, snag-and-hook connectors can alternatively be provided.

The adaptability of baby bottle hollow system 10 in use is illustrated in FIG. 1, where the child 14 has positioned the nipple 62 of bottle 38 to his mouth. This in-use position is shown in phantom lines in FIG. 2. The non-use position of system 10 is also shown in FIG. 2. In general, belt 28 is movable between a non-use position and a use position, as illustrated in FIG. 2. In the non-use position, belt 28 hangs downwards and loop member 36 is disposed below the horizontal plane of side arms 18. In the use position, belt 28 is raised upwards and loop member 36 is positioned above the horizontal plane of side arms 18. In the use position, nipple 62 of bottle 38 has been placed by the child 14 at his mouth. As shown in FIG. 2, belt 28 in its non-use position is generally disposed with the center portion of topside 30 turned downwards by the weight of bottle 38 so that nipple 62 faces outwards relative to the child 14. It is in particular noted that in the non-use position, belt 28 hangs loosely downwards with enough length to allow the child to raise bottle 38 with belt 28 to his mouth. When a biasable belt 28' is used, the length of belt 28' remains generally the same as felxible belt 28, with the biasable quality of belt 28' being of aid to the child in maneuvering bottle 38.

FIG. 2 illustrates belt 28 in the non-use position with topside 30 reversed to a downward orientation at the center portion of the belt with the bottle 38 also lying on the downward side of belt 28 and nipple 62 facing outwardly from the child. Bottle 38, being heavier than belt 28 at rest, tends to rotate to the reverse position shown. This is not necessarily the configuration of system 10 in the non-use position, however, and it is also possible for topside 30 and bottle 38 to remain in an upward position if the gravitational force on bottle 38 is balanced at both side edges of belt 28.

It is to be understood that baby bottle holder system 10 is adaptable to be connected to other types of arms extending from child's seat, such as a high chair and child's car seat.

Although the present invention has been described in some detail by way of illustration and example for purposes of clarity of understanding, it will, of course, be understood that various changes and modifications may be made in the form, details, and arrangements of the parts without departing from the scope of the invention as set forth in the following claims.

What is claimed is:

1. An improved baby bottle holder for attachment to a pair of generally horizontal, parallel side arms extending from about a supporting seat area for an infant, comprising:

a relatively short flexible belt made from a biasable material of a predetermined width and having opposed sides and opposed end portions, symmetrical quick connect connecting means at said opposed end portions for removably securing said belt to each of said pair of side arms by encircling same, and biasable loop means, of the same material as said flexible belt disposed in the mid-area of said belt, for securely holding the body of a baby bottle in said loop means and being capable of removably gripping said body of said baby bottle; said connecting means being snap-on type connectors secured to said belt and positioned at each of said end portions, each said snap-on type connector including a female receptacle and a male projection capable of being removably secured by said female receptacle, said female receptacle and said male projection being sufficiently spaced apart from each other so as to allow said end portion to encircle said side arm;

said belt being of relatively short length and movable between a first position wherein said belt generally hangs downwardly out of the way and is slack, and said loop means is disposed below the horizontal plane of said pair of side arms; and a second position wherein said belt is generally raised to the vicinity of the mouth of the infant with little slack available; and said loop means is a loop member formed by pinch gathering and sewing said belt material together to form said loop member generally of a predetermined diameter size to tightly embrace a baby bottle in said mid-area of said belt; and said belt and said loop member being made of a unitary, one-piece elastic material.

2. An improved baby bottle holder for attachment to a pair of generally horizontal, parallel side arms extending from about a supporting seat area for an infant, comprising:

a relatively short, flexible belt made from a biasable material of a predetermined width and having opposed sides and opposed end portions, symmetrical connecting means at said opposed end portions for removably securing said belt to each of said pair of side arms by encircling same, and biasable loop means, of the same materail as said flexible belt disposed in the mid-area of said belt, for securely holding the body of a baby bottle in said loop means and being capable of removably gripping said body of said baby bottle; said connecting mens being button and button hole connectors secured on said belt and positioned at each of said end portions, each said connector including a buttonhole and a button capable of being removably secured to said buttonhole, said button and buttonhole connector being sufficiently spaced apart from each other so as to allow said end portions to encircle said side arms;

said belt being of relatively short length and movable between a first position wherein said belt generally hangs downwardly out of the way and is slack and said loop means is exposed below the horizontal plane of said pair of side arms; and a second position wherein said belt is generally raised to the vicinity of the mouth of the infant with little slack available; and said loop means is a loop member formed by pinch-gathering and sewing said belt material together to form said loop member generally of a predetermined diameter size to tightly embrace a baby bottle in said mid-area of said belt; and said belt and said loop area being made of a unitary, one-piece elastic material.

* * * * *